United States Patent [19]

Spohr

[11] Patent Number: 4,887,657

[45] Date of Patent: Dec. 19, 1989

[54] SPACER FOR A VERTICAL BLIND

[75] Inventor: Horst Spohr, Cuxhaven, Fed. Rep. of Germany

[73] Assignee: Bautex Adolf Stover Sohne KG, Lang-Sievern, Fed. Rep. of Germany

[21] Appl. No.: 36,074

[22] Filed: Apr. 9, 1987

[30] Foreign Application Priority Data

Apr. 9, 1986 [DE] Fed. Rep. of Germany ..... 3611857

[51] Int. Cl.[4] ..... E06B 9/38

[52] U.S. Cl. ..... 160/178.1; 160/173

[58] Field of Search ..... 160/166.1, 168.1, 173, 160/178.1

[56] References Cited

U.S. PATENT DOCUMENTS 3,106,028 10/1963 Baumgartner ..... 24/16 PB X
3,367,701 2/1968 Wenk, Jr. ..... 24/16 PB
4,552,195 11/1985 Durig et al. ..... 160/168.1

FOREIGN PATENT DOCUMENTS 1581582 12/1980 United Kingdom ..... 160/166.1

*Primary Examiner*—Blair M. Johnson
*Attorney, Agent, or Firm*—Weiser & Stapler

[57] ABSTRACT

The invention pertains to a spacer for each of two adjacent slats of a vertical blind, each of which is attached at its upper end section to a slat holder which can move along a track, essentially consisting of a lengthwise, strip-like section which at one end section can be firmly connected in a positive manner by means of a first connection element with a second connection element of a first slat holder and can be guided along a guide on an adjacent second slat holder so that it can be moved relative to the second slat holder, and which has at its end section facing away from the first slat holder a catch by means of which it can be retained in the guide when the slats are drawn apart, wherein the first connection element is configured so that it can alternatively be firmly connected at least two points lying behind one another along the length of the spacer to a trolley.

21 Claims, 4 Drawing Sheets

SPACER FOR A VERTICAL BLIND

Figure 1:
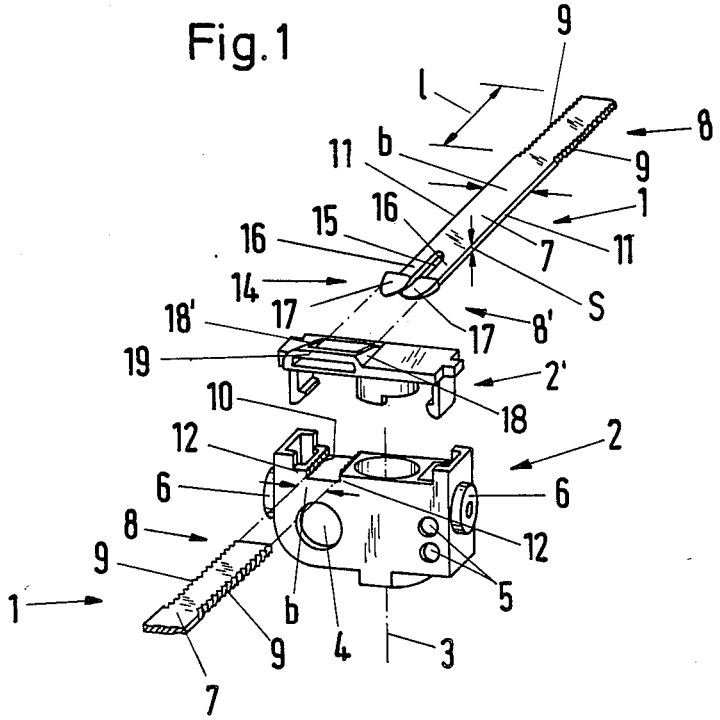

This invention relates to a spacer for each of two adjacent slats of a vertical blind, each of which is attached at its upper end section to a slat holder (generally sliding) which can move along a (support and runner) track (i.e., which can traverse in a rolling manner or be displaced in a sliding manner, configured as a trolley or slide), which comprises a lengthwise, strip-like section made of a material which will not stretch in the context of the forces which occur, such as sheet metal or plastic. The spacer, when assembled at its one end section by means of a preferably integral (first) connection element positively connected with a (second) connection element of a first slat holder holding a first slat, can be guided along a guide on an adjacent slat holder holding an adjacent second slat so that when the slats are brought together into a bundle of slats, it can be moved or displaced in its lengthwise direction relative to the second slat holder. The spacer has at its end section facing away from the first slat holder a catch by means of which the spacer can be retained in the assembled position in the guide of the second slat holder when the two slats are drawn apart.

It is known that vertical blinds generally serve as sun and/or privacy protectors for windows, although they are also applied for other purposes, for example, as room dividers. Their slats, generally consisting of textile material, configured as strips and placed vertically, are each attached at least at their upper end to a trolley, slide or the like, referred to above and hereinafter as a slat holder, and can generally be pivoted about a central longitudinal axis, such that in general, all of the slats of a vertical blind can be pivoted together simultaneously by means of a common drive system. The slat holders are generally retained in a track which serves both as support track and guide track, along which the slat holders, and therefore the slats, can be moved by means of a drive system.

In the open position, in which the window or the like is not covered by the slats, the slats are brought together at one side of the window or the like in a bundle, with the slats running parallel to one another. If the window or the like needs to be completely or partially covered by the slats of the vertical blind, the traverse drive system (by means of which, in certain vertical blind designs, the slats can also be pivoted) is actuated. The traverse drive system generally acts upon the slats or their slat retaining systems so that the first slat at the front is the one initially caused to move. Once the first slat has reached the predetermined distance from the second slat adjacent to it, the second slat begins to move, and so forth until finally all of the slats have been moved and the window or the like has been correspondingly covered. In this position (or also in intermediate positions), the slats can be pivoted about their longitudinal axes by means of the pivoting drive system.

The distance between two adjacent slats in the extended position is such that in the closed position, the adjacent edge sections of the slats overlap to block visibility or the entry of light from outside. This distance between each two adjacent slats is determined by so-called spacers, which are placed between each of the adjacent slat holders, namely, trolleys or slides, for the adjacent slats.

Known spacers between the slats of vertical blinds are so-called ball chains, which consist of a thread, cord or the like onto which essentially spherical plastic bodies are injection-molded, each at the same spacing. Spacers of this type, however, are obviously only suitable for the free lower ends of the slats which are not guided in a track, since the ball-chain sections present between two adjacent slats which hang down in loops when the vertical blind is drawn together would make it impossible or at least difficult to bring the slat holders close together if they were used as spacers in the area of the support track.

For many years, therefore, the spacers for vertical blinds had been made as long, strip-like lengths of metal or plastic, each of which is solidly connected at one end, in the manner described above, to a first slat holder, and which are guided on an adjacent slat holder so that when the slats or the slat holders are brought together, they can each be displaced with respect to the said adjacent slat holder, with a catch serving to prevent the spacer, when the slats or slat holders are drawn apart, from becoming detached from the particular adjacent slat holder which guides it.

In one known spacer, the strip-like length (width ca. 7 mm, thickness ca. 0.7 mm) is made of plastic and has at one end section a rectangular or round catch, placed on the underside of and formed in one piece with the strip-like length, which in the assembled state engages in a corresponding recess in the slat holder configured as a trolley and consequently forms the (first) connection element.

At the top, the known spacer has a projecting flange at each of its edges in the region of this end section, which in the assembled state engages beneath corresponding projecting flanges on the trolley, so that with this positive fit, the spacer can be firmly connected to the trolley.

At the other end, this known spacer is slightly expanded and thickened on each side to form a stop with respect to the strip-like section, with the free end of the spacer on this side being shaped slightly more convexly so that while it can be displaced between two corresponding guide flanges of the adjacent trolley up to the stop relative to the said adjacent trolley, it cannot come loose from the trolley which carries it when it reaches the predefined maximum distance from the trolley adjacent to it.

This known spacer is relatively economical to manufacture and also meets the demands placed upon it, but it can obviously only be used for a certain predefined distance between two slat retainers adjacent to one another.

This also applies to other similar configured known spacers, for example, a spacer made of sheet metal (of similar width and thickness). In this known spacer, one end is bent under at a right angle to the strip-like section, and the resulting flange contacts the housing of the slat holder, also configured as a trolley, such that the spacer is prevented from lifting off the corresponding trolley by the fact that one web of the trolley is placed above each of the spacers. To prevent this end of the spacer from shifting towards the corresponding trolley, a lug is punched out at the above-described end section at a certain distance from the downwardly bent flange and is bent under in the direction of the flange out of the plane of the strip-like section, such that a web of the corresponding trolley is placed between the flange, on the one hand, and the lug, on the other hand, so that the spacer is positively retained on the trolley by this end section.

One of the above-mentioned webs or a slot in the trolley, under which the spacer is inserted, serves to guide the spacer along the adjacent trolley. To prevent the spacer from being pulled out of the adjacent second trolley, it is bent at this end into a U-shape, so that the resulting stop in the maximum traverse position between two adjacent trolleys ensures that the spacer fulfills its function and cannot be pulled out of the adjacent trolley.

This previously known spacer is again obviously only applicable for a predetermined distance between two adjacent slat holders (and therefore slats).

The same applies to a further previously known spacer, in which the (first) connection element is created by the fact that on the corresponding end of the spacer, a rectangular hole is punched in the latter, and that a plastic body with a corresponding stop is provided, the catch on which extends from above through the hole in the spacer to reach its lower side, so that it can come into corresponding positive engagement with a trolley, as already described above with reference to the first known embodiment.

The disadvantage already mentioned many times, that the known spacers are each only applicable for a predetermined distance between two adjacent slats, has an extraordinarily negative effect in practice, last but not least in that it ultimately leads, in economic terms, to correspondingly higher costs. This is immediately evident when one learns that spacers for vertical blinds are used by the million every year in a variety of sizes, and that manufacturers of vertical blinds must manufacture and especially keep in stock up to 15 or more different sizes of spacer. The latter problem is particularly serious because vertical blinds are usually sold not directly from the manufacturer to the end user, but through design firms which fabricate vertical blinds to the particular required dimensions for furniture stores or the like, or directly for end users, so that it is impossible for the maker to produce spacers for individual orders. Rather, a corresponding stock of all components, including spacers, must be maintained both by the actual maker and by the design firms.

The above-mentioned large number of spacers with different working lengths initially results from differing slat widths, which must necessarily be offered for different applications. But even when the slat width is the same, the same spacer cannot always be used, since their length must obviously be smaller for a horizontally oriented support track than for an obliquely oriented support track, which occurs frequently with correspondingly shaped windows or the like.

Although since the creation of vertical blinds, meaning for decades, manufacturers have found it extraordinarily inconvenient to have to manufacture and stock not only the usual components of vertical blinds but also enormous quantities of between 10 and 20 different spacers, this inconvenience has until now been supposed to be unavoidable, since people have evidently assumed that it is practically a necessary consequence of the technical requirements for a spacer that, one the one hand, it must be firmly connected at one end by positive engagement with a first slat holder, which must furthermore traverse relative to an adjacent slat holder, and which lastly must have at its other end a stop which prevents it from sliding out of the guide on this adjacent slat holder.

The purpose underlying the present invention is that of creating a spacer of this type which can be used for several (at least two, preferably many) applications, such that the spacer should nevertheless be, if possible, no more expensive than known spacers which are each only useable for one distance.

According to the invention, the solution provided for this purpose is that the (first) connection element of the spacer (i.e., the connection or coupling element by means of which it is firmly and positively connected to a slat holder configured as a trolley, slide or the like) is configured so that it alternatively can be connected to a trolley at at least two points lying behind one another along the length of the spacer, wherein with a view to the desired optimization of the advantages which can be attained according to the invention, it is preferably provided that the (first) connection element can be firmly connected to the trolley at each of a plurality of points lying behind one another along the length of the spacer, namely, at at least three, but preferably considerably more points, so that a small number of different spacers, in the ideal case only one single spacer, can suffice for all applications.

One preferred configuration of the spacer according to the invention is characterized by at least two recesses placed behind one another along the length of the strip-like section, one recess of which can in each case be alternatively positively connected to one corresponding projection or catch on a slat holder. In terms of this configuration, it is obviously basically possible to use the reverse solution as well, namely, to provide the strip-like section with projections or catches placed behind one another, and for the slat holders each to have corresponding recesses, but this reverse solution is considered less desirable, since, on the one hand, it is more expensive and, on the other hand, the projections or catches on the strip-like section might possibly interfere with the motion of the spacer with respect to the corresponding slat holder.

One embodiment of a slat holder of this type comprises having the (first) connection element configured as teeth, which in the assembled state positively engage with corresponding teeth on the matching slat holder which form the second connection element, namely, the connection element on the slat holder. Several variations are again possible with this configuration. For example, one possible configuration involves having the teeth of the (first) connection element placed on at least one lengthwise edge of the spacer (preferably both lengthwise edges). This then means that the corresponding slat holder is provided with two rows of teeth running parallel to one another, the distance between which corresponds to the width of the spacer, so that the toothed section of the latter forming the first connection element can be positively connected to the slat holder at various points.

In one embodiment in which the spacer has (at least) one slot running along its length between its upper and lower sides, the teeth of the (first) connection element can be formed on (at least) one lengthwise edge of the slot (preferably on its lengthwise edges), such that the corresponding teeth of the slat holder are then located on a corresponding projection on the slat holder, as explained in more detail below with reference to an example of an embodiment.

Basically, the teeth forming the (first) connection element of the spacer can also be placed on the upper and/or the lower side of the spacer, but this configuration is generally less advantageous, since it requires a corresponding thickness in the spacer which would have to be greater than the minimal thickness necessary for reasons of strength.

According to a further embodiment of the present invention, the recesses forming the (first) connection element can also be created by a row of through holes placed behind one another along the length of the spacer, as also explained below with reference to an example of an embodiment, such that in the assembled state, one hole in each case forms the (first) connection element, which positively engages with a corresponding catch, projection or the like on the slat holder.

A further embodiment of the spacer according to the invention is also characterized by a lengthwise slot passing through it, which ends at some distance from one end of the spacer and there forms the stop and which extends to the other end of the spacer. This configuration makes it possible to prefabricate the spacers according to the invention not as individual components, but, for example, as a roll of coiled, strip-shaped material from which the individual spacers can be cut off as needed depending on the desired predetermined length, as explained below with reference to an example of an embodiment.

Preferred configurations of the present invention are described below.

Figure 2:
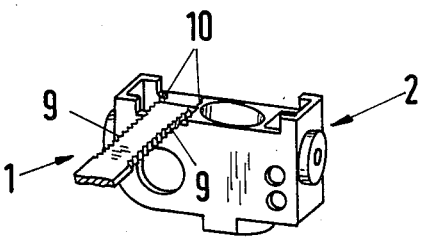
Figure 3:
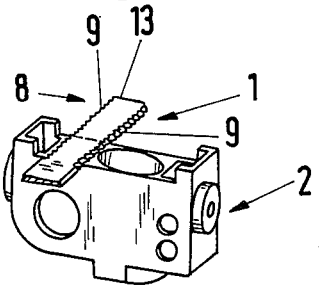
Figure 4:
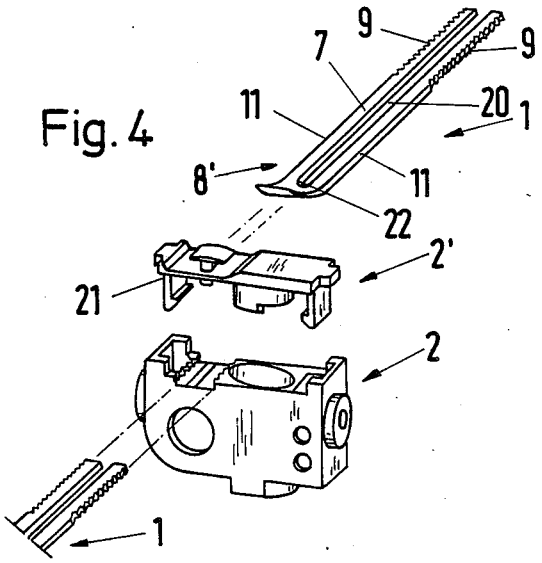

The invention is explained further below with reference to examples of the embodiments and referring to FIGS. 1–7 wherein:

FIG. 1 shows a perspective view of an embodiment of a spacer according to the invention as well as a slat holder configured as a trolley, in exploded view, FIG. 2 shows the spacer according to FIG. 1, in the assembled state, FIG. 3 shows the spacer of FIG. 2, assembled for a smaller distance, FIG. 4 shows an embodiment corresponding to FIG. 1, wherein the spacer is provided with a longitudinal slot open at the end having the first, connection element.

Figure 4A:
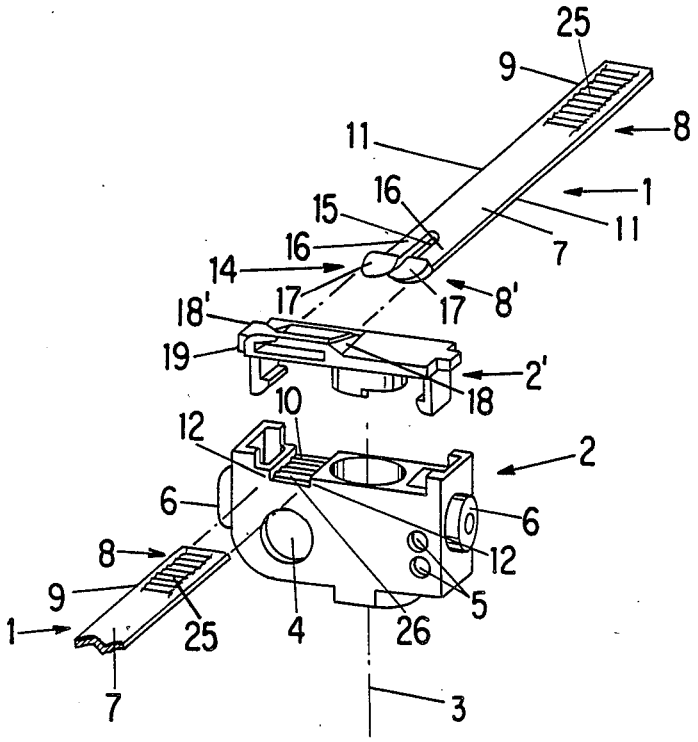

FIG. 4*a* shows an embodiment corresponding to FIG. 1, wherein faces at the end of the spacer are provided with the first connection element.

Figure 5:
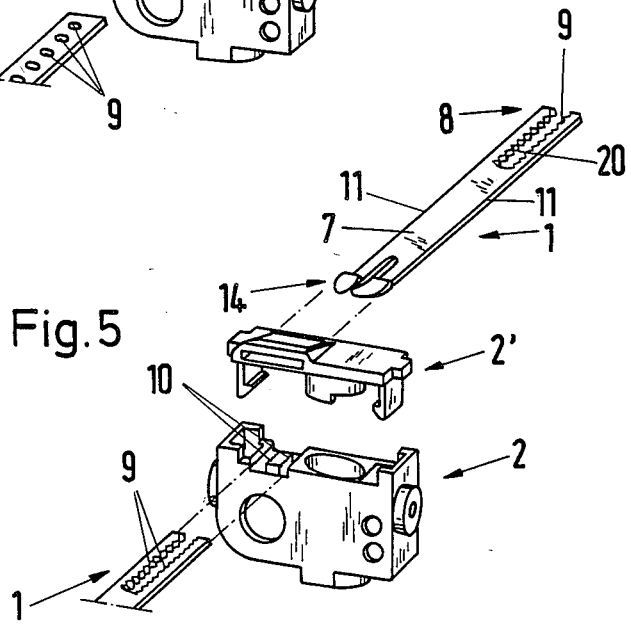

FIG. 5 a shows further embodiment of the spacer wherein the first connection element comprises a longitudinal row of holes.

Figure 6:
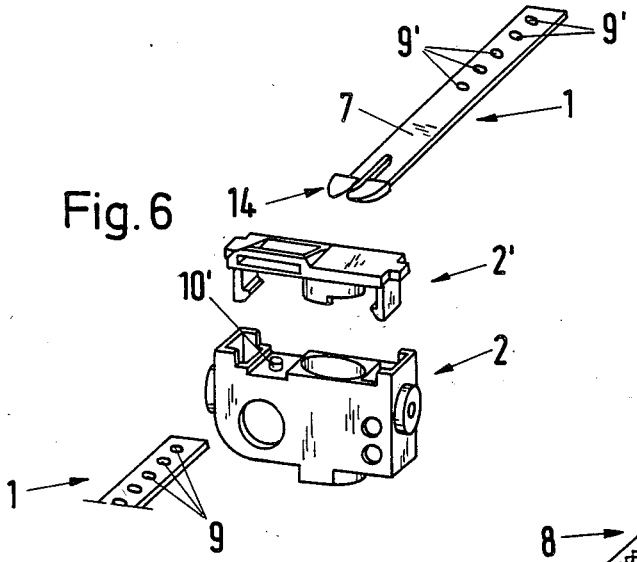
Figure 7:
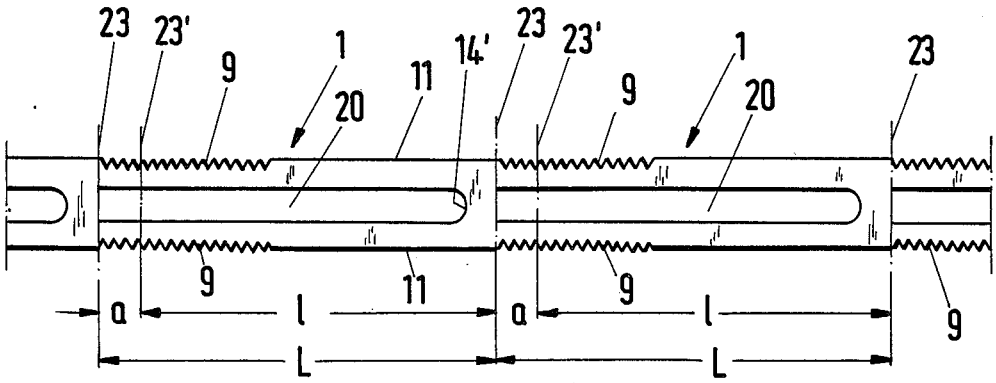

FIG. 6 shows a further embodiment of the spacer wherein there is a slot at either end, and FIG. 7 shows a further embodiment of a spacer according to the invention, which can even be cut out of a coiled reserve of strip-shaped material.

FIG. 1 shows, in an exploded view, two spacers collectively designated as 1, with only one end section of spacer 1, shown in the lower left part being illustrated. The spacer 1 serves to connect together two adjacent slats (not illustrated in the drawing) of an overall vertical blind (also not illustrated in the drawing); more precisely stated, it serves to connect trolleys serving as slat holders 2. Since the placement of the slats on the trolley 2, and the placement of the trolleys 2 in a support track (also not illustrated), etc. are not objects of the present invention and are moreover known to relevant persons skilled in the art, it will merely be mentioned that each of the slats is connected to the trolley 2 at its upper end section with a hook or the like and can pivot about a vertical axis 3 to a limited extent. Fulfilling this purpose is a drive shaft (also not illustrated in the drawing) which extends through a pass-through hole 4 in each trolley, in which a threaded nut (also not illustrated in the drawing) is placed which is equipped on its outer side with a helical thread which engages with a pinion placed concentrically with the vertical axis 3.

In addition, the slats attached to each of the trolleys 2 can traverse in the lengthwise direction of the spacer. Fulfilling this purpose in the illustrated embodiment is a draw cord (also not illustrated in detail) which extends through the holes 5, 5 in the trolley 2. The traverse drive can, however, also be configured in another manner.

The only important thing is that the trolleys 2 serving as slat holders can travel by means of their rollers 6 along a support track (not illustrated in the drawing).

At one limit position, all of the trolleys 2 of the vertical blind are essentially collected together into a single bundle and are immediately adjacent to one another. In the other limit position, in which the window or the like to be covered by the vertical blind is completely covered by the vertical blind, the trolleys 2 are at a certain distance from one another which is defined by the spacers 1.

Each of the spacers 1 consists of a long strip-like section 7 made of a material that does not stretch in the context of the forces which occur, such as sheet metal or plastic. In the embodiment illustrated, the width b of the spacer 1 is ca. 7 mm, and its thickness S is ca. 0.7 mm.

At their end sections 8, the spacers 1 are each equipped with a (first) connection element 9 formed as a single unit with the strip-like section 7, by means of which they can be firmly and positively connected to a second connection element 10 of a trolley 2 holding a first slat. The first connection element 9, in the embodiment according to FIG. 1, consists of teeth placed on both lengthwise edges 11 of the spacer 1 which extend, beginning from the end at the end section 8, over a length 1, but which obviously could extend even further, possibly over the entire length of the strip-like section 7.

Each trolley 2 has corresponding teeth which are formed on the opposite facing side of two shoulders 12 which are at the same distance b from one another as the two lengthwise edges 11, 11 of the spacer 1.

For installation, therefore, one spacer according to FIG. 2 can be engaged, by means of its teeth forming its (first) connection element 9 with the teeth 10 forming the (second) connection element of the trolley 2 so that only a few of the teeth on its end section 8 extend into the trolley 2, by means of which it can be positively connected to the trolley 2, especially if the head 2′ of the trolley 2 is subsequently installed. If, however, as shown in FIG. 3, another and specifically a smaller distance between two adjacent trolleys in their drawn-apart state is defined, the spacer 1 can be connected with the teeth forming the (second) connection element 10 of the trolley 2 in the manner shown in FIG. 3, such that the section 13 projecting beyond the trolley and shown cross hatched in FIG. 3 can be cut off by means of a suitable device, possibly immediately before installation of the spacer 1, if it would interfere with proper operation, i.e., if a corresponding through hole is not present in the trolley into which this section 13 could be inserted when the trolleys 2 are drawn together into a bundle.

A stop, collectively designated as 14, is present at the other end section 8′ of the spacer 1. At this end section 8′, the strip-like section 7 of the spacer 1 has a slot 15 along its length. Each of the two legs 16 formed by the slot 15 bears a catch 17 projecting laterally beyond the strip-like section 7 and tapering towards the free end, which serves as the stop for the spacer 1, such that the two catches 17, 17 are each wedge-shaped in section and that they taper in thickness in the direction of the other catch 17, so that when the legs 16, 16 are elastically deformed, they will be displaced toward one another if this is desirable during assembly.

The head 2' of the trolley 2 has a guide 18 for the spacer 1, so that the latter can shift while guided in the lengthwise direction relative to an adjacent trolley 2, to which its end section 8 is not connected.

In the assembled state, the end section 8 of each spacer 1 is firmly attached by positive engagement in the manner shown in FIGS. 2 and 3 (depending on the desired distance) and then guided out by the corresponding trolley 2 to an adjacent trolley 2, where it extends between the two jaws of the guide 18, beneath a web 19 through a slot 18', which, like the web 19, is also a component of the guide, to the point where the stop 14 is located on this side of the web 19 in FIG. 1, so that the spacer 1 can shift in the guide 18, 18', 19 relative to the corresponding trolley only until its stop 14 contacts the web 19.

FIG. 4 shows a variant in which identical or identically functioning parts are identified with the same item numbers as in FIGS. 1 through 3. In the configuration according to FIG. 4, the (first) connection element 9 is also configured as teeth on the lengthwise edges 11 of the strip-like section 7, but the spacer is equipped with a central slot 20 running along its length, by means of which it is slid onto a peg 21 provided on the head 2' of the trolley 2, so that the front end 22 of the slot 20 or the edge turned up at the front end section 8' forms the stop 14.

FIG. 4*a* shows yet another variant in which identical or identically functioning parts are identified with the same item numbers as in FIGS. 1 through 3. In the configuration according to FIG. 4*a*, the (first) connection element 9 is again configured as teeth, but in this case on opposing faces 25 of the strip-like section 7. The (second) connection element 10 is provided with correspondingly configured teeth 26 formed in both the trolley 2 and its corresponding head 2', for engaging the teeth on the strip-like section 7 as the head 2' engages the trolley 2.

In the embodiment according to FIG. 5, the (first) connection element 9 of the spacer is again configured as teeth, but they are located not on the lengthwise edges 11 of the strip-like section 7, but on the edges of a slot 20 which extends from the free end of the end section 8 along the length of the spacer 1 for a certain distance. In this case, the second connection means 10 on the trolley 2, also configured as teeth, is configured as a small block which is located on the upper side of the trolley 2 (beneath the head 2') and equipped on its lateral edges with teeth, such that the connection between the two connection elements 9 and 10 is made in a manner similar to that described for the embodiment according to FIGS. 1 through 3, and such that any projecting end section (such as section 13 in FIG. 3) can again be cut off if necessary.

FIG. 6 shows a further variant of the spacer 1 according to the invention, in which the first connection element 9 of the spacer is also configured so that it can alternatively be firmly connected by positive engagement at several points behind one another along the length of the spacer 1 to a slat holder 2, and such that this can also be accomplished by having the strip-like section 7 equipped with recesses placed one behind the other, of which alternatively (at least) one recess can in each case be positively connected with a corresponding projection or catch on a slat holder (trolley). In the configuration according to FIG. 6, the strip-like section 7 of the slat holder 1 is equipped with several through holes 9' placed one behind the other along the length of the spacer 1, and each trolley 2 has a correspondingly configured peg 10' which projects vertically upward from a horizontal plane. Depending on the desired predetermined distance, one hole 9' in each spacer 1 can be slid over a peg 10' on a trolley 2 and in this manner be positively connected therewith before the trolley head 2' is snapped on.

It will be immediately obvious to the relevant person skilled in the art that in addition to the above-mentioned embodiments as examples, a number of other possibilities exist for realizing the spacer according to the invention.

One of these further embodiments is illustrated in FIG. 7 in plan view. It differs from the embodiments described hitherto in that the spacers 1 are each cut out to the desired length from a strip-shaped material. This strip-shaped material, in the form of a coiled roll, has teeth 9 along each of its lengthwise edges 11, said teeth forming the (first) connection element in the finished spacers 1. In addition, the strip-shaped material is equipped with lengthwise slots 20.

If spacers 1 need to be formed to a length L, each is then cut off from the strip-shaped material at the dotted cutting lines 23. They are then each connected to a trolley 2 in the manner illustrated and described with reference to FIGS. 1 through 4, with the stop 14' being created by the front end of the slit 20, which, as in the configuration according to FIG. 4, engages in the assembled state with a peg 21 or the like.

If, however, shorter spacers 1, for example, with a length 1, need to be created, the cut along a cutting line 23 is initially followed in each case by a further cut along a cutting line 23' and then again by one along a cutting line 23, and so forth, with a waste piece of length a being produced in each case. The cost associated with this waste is, however, vanishingly small as compared with the cost that hitherto arose because of the need to stock approximately 15 to 20 different spacers 1. This also obviously applies to spacers such as those described with reference to FIGS. 1 through 6, if a section 13 is cut off from the end section 8 of these spacers.

With a spacer 1 as described, for example, with reference to FIG. 7, it is evidently possible to satisfy all requirements, so that a single semi-finished part suffices for all applications and stock requirements can consequently be reduced to a fraction. In a practical application, the manufacturer or designer need only cut off corresponding lengths from the semi-finished product using a suitable device.

Obviously, these advantages also fundamentally apply to the embodiments according to FIGS. 1 through 6, such that with these spacers as well, all applications can be accommodated if necessary. In any event, a group of different spacing lengths can be accommodated with only a single spacer for which the manufacturing cost is obviously at least not appreciably higher than is the case with known cut-off holders.

The possibility of placing plastic spacers in variably adjustable lengths to space out trolleys in the track means that all the slats are at the same distance along the track, which is not possible with spacers with the fixed dimensions so far defined. As a result, the slats when closed hang optimally, and completely uniformly over the entire width of the track. The spacer length between the individual slats is calculated from the particular required width of the track.

Accordingly, with the variable length spacer of the invention, it is possible to assemble vertical blinds wherein the slat holders and the slats are evenly spaced along the length of the track, irrespective of the length of the track. With the known spacers of the prior art the track would have to be a length which is evenly divisible by the fixed length of the known spacer.

I claim:

1. An assembly for separating adjacent slats of a vertical blind, which slats are receivable within slat holders which are movable along a track, and which assembly comprises a lengthwise strip-like spacer having at one end a first connection element connected to a second connection element in a first of the slat holders and at the other end a catch for retaining the spacer in a guide on a second of the slat holders, wherein the spacer can be moved longitudinally through the guide on the second of the slat holders, and wherein the first connection element has at least two recesses along the length of the spacer and the second connection element includes a corresponding projection on the first of the slat holders for connecting at least one of the recesses of the spacer to the first of the slat holders at one of at least two longitudinally distinct points.

2. The assembly of claim 1 wherein the spacers place the slat holders and the slats at evenly spaced positions along the length of the track irrespective of the length of the track.

3. The spacer of claim 1 wherein the spacer is connectable to the slat holder at each of a plurality of points lying along the length of the spacer.

4. The spacer of claim 1 wherein the recesses of the first connection element are teeth which are engagable with teeth forming the second connection element in the first slat holder.

5. The spacer of claim 4 wherein the teeth of the first connection element are along at least one longitudinal edge of the spacer.

6. The spacer of claim 5 wherein the teeth of the first connection element are along both longitudinal edges of the spacer.

7. The spacer of claim 4 wherein the spacer is provided with a longitudinal slot.

8. The spacer of claim 7 wherein the teeth of the first connection element are along at least one longitudinal edge of the slot.

9. The spacer of claim 8 wherein the teeth of the first connection element are along both longitudinal edges of the slot.

10. The assembly of claim 4 wherein the teeth of the first connection element are positioned along at least one surface of the spacer.

11. The spacer of claim 1 wherein the recesses of the first connection element are a longitudinal row of holes such that each hole forms a first connection element.

12. The spacer of claim 7 wherein the slot is open at one end.

13. The spacer of claim 12 wherein the slot is open at the end having the catch.

14. The spacer of claim 13 wherein the catch on the end projects above the longitudinal surface of the spacer on at least one of the two legs formed by the slot.

15. The spacer of claim 14 wherein the catch projects laterally beyond the strip-like element.

16. The spacer of claim 15 wherein the catch tapers towards the catch end of the strip-like element.

17. The spacer of claim 13 wherein a catch is present on each leg formed by the slot.

18. The spacer of claim 17 wherein at least one catch is wedge shaped such that it tapers in thicknes in the direction of the other catch.

19. The spacer of claim 18 wherein both catches are wedge shaped.

20. An assembly which separates adjacent slats of a vertical blind, which slats are receivable within slat holders which are movable along a track, and which assembly comprises a lengthwise strip-like spacer having at one end a first connection element fixedly connected to a second connection element in a first of the slat holders and at the other end a catch slidably retaining the spacer in a guide on a second of the slat holders, wherein the spacer can be moved longitudinally through the guide on the second of the slat holders, and wherein the first connection element and the second connection element include means which connect the spacer to the first of the slat holders at one of at least two longitudinally distinct points, whereby the spacing between the slat holders is adjustable.

21. An assembly including a spacer for separating each of two adjacent slats of a vertical blind, and slat holders for receiving each of the two adjacent slats and movable along a track, the spacer comprising a lengthwise strip-like element having at one end a first connection element with at least two points along the length of the spacer for fixed connection to a second connection element in a first of the slat holders and at the other end a catch which slidably retains the spacer in a guide on a second of the slat holders, wherein the spacer can be moved longitudinally through the guide on the second slat holder, and wherein the first connection element is fixedly and removably connected to the second connection element at either one of said at least two points along the length of the spacer.

* * * * *